US007774882B2

(12) United States Patent
Liou

(10) Patent No.: US 7,774,882 B2
(45) **Date of Patent: *Aug. 17, 2010**

(54) MULTI-FUNCTION TOOL

(76) Inventor: Mou-Tang Liou, No. 25, Lane 86, Ta Wei Road, Ta Li, Taichung Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/139,555

(22) Filed: Jun. 16, 2008

(65) Prior Publication Data

US 2009/0307847 A1 Dec. 17, 2009

(51) Int. Cl.

| | |
|---|---|
| ***B66F 15/00*** | (2006.01) |
| ***B25F 1/00*** | (2006.01) |
| ***B25D 1/04*** | (2006.01) |
| *B25B 13/10* | (2006.01) |

(52) U.S. Cl. ..... 7/166; 7/139; 7/143; 254/18

(58) Field of Classification Search ..... 7/139, 7/143, 166; 81/129, 154, 177.1, 177.85, 81/489, 491; 254/115, 116, 130, 18, 21, 254/25, 26 E; D8/89

See application file for complete search history.

(56) References Cited

U.S. PATENT DOCUMENTS

| | | | | |
|---|---|---|---|---|
| 404,001 | A * | 5/1889 | Heacock | 7/139 |
| 540,967 | A * | 6/1895 | Eveleth | 254/26 E |
| 780,305 | A * | 1/1905 | Riggin | 81/144 |
| 856,097 | A * | 6/1907 | Palmer | 254/26 E |
| 885,363 | A * | 4/1908 | Myers | 81/145 |
| 1,132,879 | A * | 3/1915 | Rairden | 254/26 E |
| 5,249,776 | A * | 10/1993 | Johnson | 254/26 E |
| 5,845,354 | A * | 12/1998 | Long et al. | 7/139 |
| 6,058,814 | A * | 5/2000 | Johnson | 81/177.2 |
| 6,827,333 | B1 * | 12/2004 | Lutz | 254/26 E |
| 2004/0045416 | A1 * | 3/2004 | Liou | 81/177.1 |
| 2009/0050861 | A1 * | 2/2009 | Noah et al. | 254/26 E |

* cited by examiner

*Primary Examiner*—David B Thomas
(74) *Attorney, Agent, or Firm*—Alan Kamrath; Kamrath & Associates PA

(57) ABSTRACT

A multi-function tool has a shank body including a first end, a second end and a plurality of positioning grooves formed between the first and second ends thereof. A pry bar includes a connected section and a working section extending from a side of the connected section for pulling nails. A through-hole pierces the connected section for slidably receiving the shank body, with a second receptacle piercing the connected section and in communication with the through-hole. A clutch is disposed in the second receptacle for alternatively engaging with a selected one of the positioning grooves.

29 Claims, 11 Drawing Sheets

MULTI-FUNCTION TOOL

BACKGROUND OF THE INVENTION

1. Field of the Invention

The present invention relates to a multi-function tool adapted for nail pulling and prying. More particularly, the present invention relates to a multi-function tool having a pry bar whose location thereon is adjustable.

2. Description of the Related Art

A conventional tool for nail pulling and prying material on the surface includes a pry bar formed on an end thereof and a handle formed on another end thereof. However, the tool is usually formed as one piece, and the distance between the pry bar and the handle cannot be adjusted. Thus, the tool is just adapted for pulling nails whose size is limited to a particular range, and if the nail is of a size over the range, the tool could not pull out the nail fully. Moreover, when a user operates the tool to pry something on a narrow place, it is difficult to find a fulcrum for supporting.

Therefore, the present invention is intended to obviate or at least alleviate the problems encountered in the prior art.

SUMMARY OF THE INVENTION

It is therefore an object of the present invention to provide a multi-function tool that is adapted to adjust the distance between a pry bar thereof and the ground for pulling nails which have various sizes of length.

Accordingly, the present invention provides a multi-function tool including a shank body, a pry bar slidably mounted on the shank body longitudinally and a clutch coupling the pry bar to the shank body. The shank body includes a head portion formed on a first end thereof for nail pulling, a second end inserted through the pry bar and a plurality of positioning grooves aligned thereon from the second end to the first end. The pry bar includes a connected section for engaging with a selected one of the positioning grooves, a working section for nail pulling and a second receptacle formed on a side thereof for receiving a clutch. The clutch is adapted for fixing the pry bar to the selected one of the positioning grooves so that the pry bar can be adjusted to a desired location on the shank body.

Other objectives, advantages, and features of the invention will become more apparent from the following detailed description when taken in conjunction with the accompanying drawings.

BRIEF DESCRIPTION OF THE DRAWINGS

The present invention will be described via detailed illustration of the preferred embodiments referring to the drawings.

DETAILED DESCRIPTION OF THE PREFERRED EMBODIMENT

Figure 1:
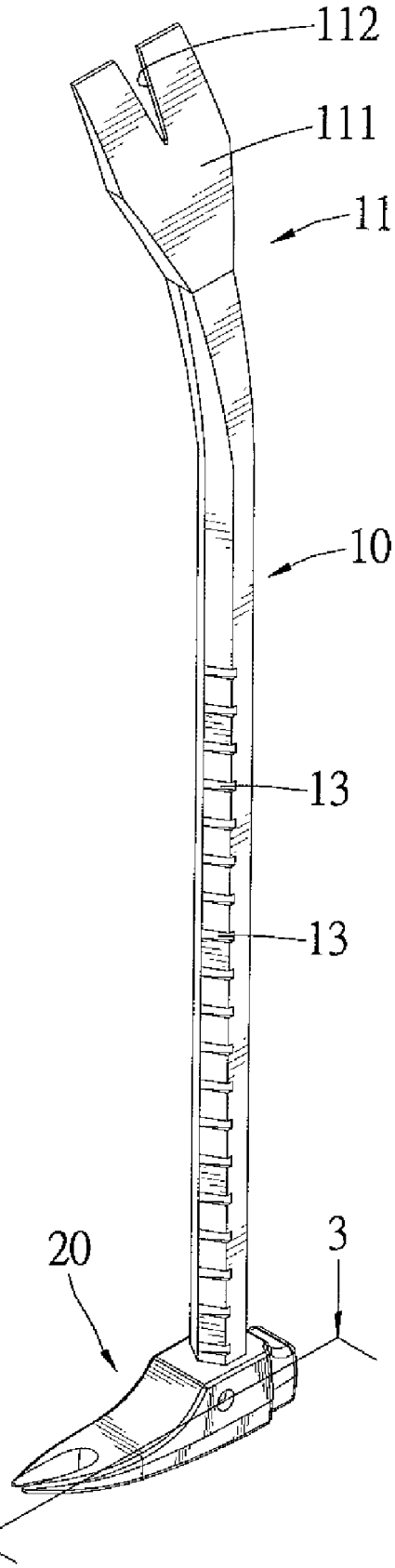
FIG. 1 is a perspective view of a multi-function tool according to the first embodiment of the present invention.
Figure 2:
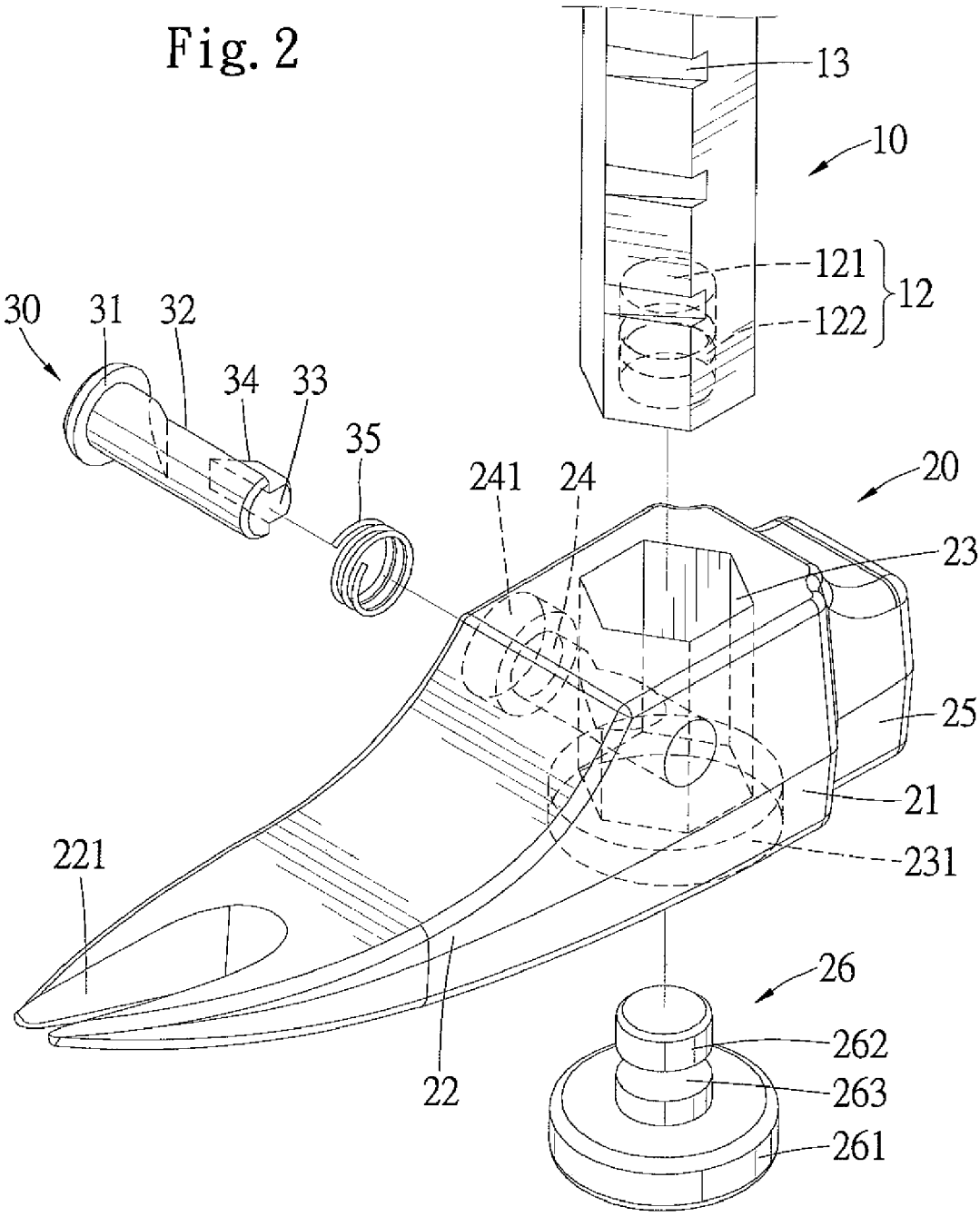
FIG. 2 is a partial, exploded view of the multi-function tool shown in FIG. 1.
Figure 3:
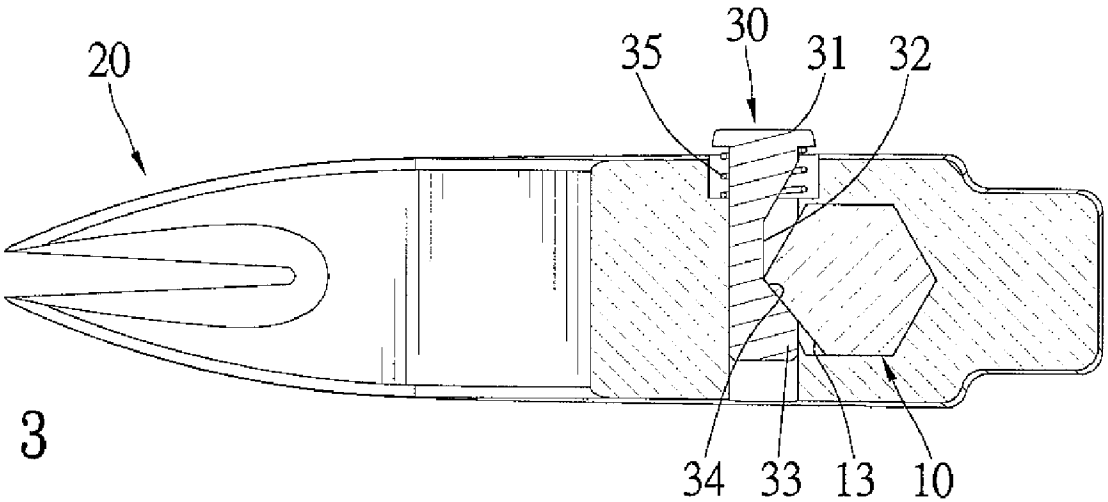
FIG. 3 is a cross-sectional view taken along 3-3 in FIG. 1.

Referring to FIGS. 1 through 3, a multi-function tool in accordance with a first embodiment in the present invention, includes a hexagonal shank body 10, a pry bar 20 slidably mounted on the shank body 10 longitudinally and a clutch 30 coupling the pry bar 20 to the shank body 10.

The shank body 10 includes a first end 11 and a second end 12. A head portion 111 is formed on the first end 11 and is capable of prying materials on narrow conditions. A slot 112 is defined on the center of the head portion 111 for nail pulling. The second end 12 includes a receiving portion 121 formed therein longitudinally and opening to outside thereof, and a projection 122 is annularly formed on the inner wall of the receiving portion 121. A plurality of positioning grooves 13 are defined on the outer periphery of the shank body 10, with the positioning grooves 13 aligned from the second end 12 to the first end 11. The, interval between each of the positioning grooves 13 is alternatively constant or not.

The pry bar 20 includes a connected section 21 mounted on the shank body 10, a working section 22 extending therefrom and transverse to a side of the shank body 10 and a terminal end 25 projecting from an end of the connected section 21 and opposite to the working section 22. A hexagonal through-hole 23 pierces the connected section 21, with the direction of axis of the through-hole 23 being parallel to that of the shank body 10. The periphery of the through-hole 23 corresponds to the outer periphery of the shank body 10. A first receptacle 231 is formed on the bottom of the through-hole 23 and opposite to the first end 11 of the shank body 10. A fixed member 26 is disposed in the through-hole 23 and includes a first end forming a flange 261 slightly protruding from the first receptacle 231 and a second end forming an inserted end 262 received in the receiving portion 121 of the shank body 10. An annular groove 263 is defined on the inserted end 262 and corresponds to and is provided to receive the projection 122 for fixing the fixed member 26 in the second end 12 of the shank body 10. The inserted end 262 of the fixed member 26 is provided with elasticity so that it is easy to press the fixed member 26 into the second end 12 of the shank body 10. A second receptacle 24 transversely pierces the connected section 21 and in communication with the through-hole 23, with the direction of axis of the second receptacle 24 being perpendicular to that of the through-hole 23 and that of the working section 22, respectively. A limited end 241 is formed on an end of the second receptacle 24, with the diameter of the limited end 241 being larger than that of the second receptacle 24. A claw portion 221 is defined on the working section 22 for nail pulling.

Figure 4:
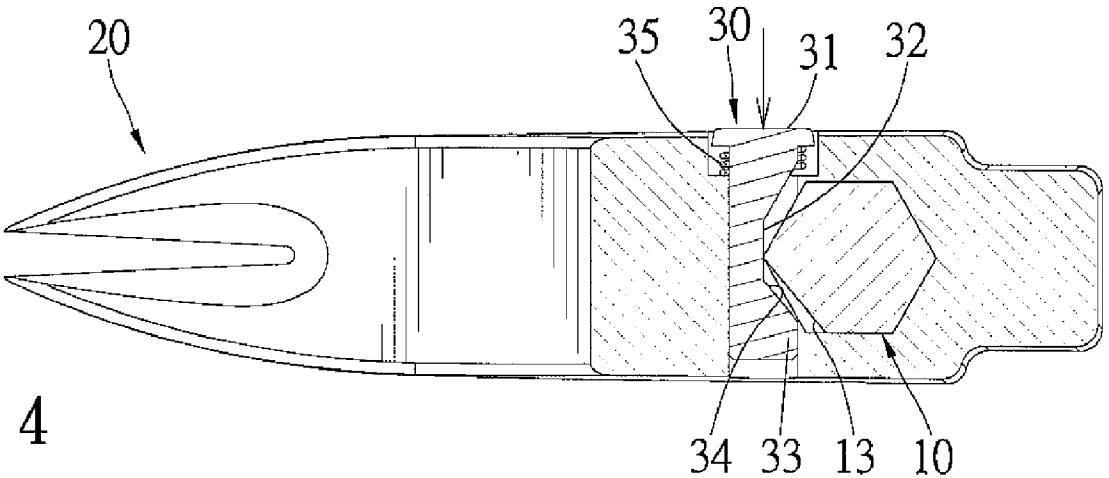
FIG. 4 is another cross-sectional view similar to FIG. 3, illustrating pressing the switch device to detach from one of the positioning grooves of the shank body shown in FIG. 2.

The clutch 30 is in form of a column and disposed in the second receptacle 24 to selectively engage with the selected one of the positioning grooves 13 for fixing the pry bar 20 on the desired location of the shank body 10. The clutch 30 includes a first end defining a flange 31 for abutting against the limited end 241 and a second end defining a protrusion 33 for exactly inserting into the selected one of the positioning grooves 13. An abutted surface 34 is defined on the protrusion 33 so that when the protrusion 33 is inserted in the selected one of the positioning grooves 13, the abutted surface 34 just abuts with the inner wall of the positioning groove 13 for a secure engagement of the pry bar 20 and the shank body 10. A sunken portion 32 is provided between the first and second ends of the clutch 30. When sunken portion 32 is aligned with the through-hole 23, the shank body 10 extends through the clutch 30 and is set in the through-hole 23 of the pry bar without contact with the clutch 30. The clutch 30 further includes an elastic element 35 mounted thereon and adjacent to the flange 31. When the clutch 30 is in an engaging position and the elastic element 35 is released, the protrusion 33 is engaged with the selected one of the positioning grooves 13, and the abutted surface 34 abuts with the inner wall of the selected one of the positioning grooves 13 (shown in FIG. 3). When the clutch 30 is in a disengaging position and the elastic element 35 is pressed, the protrusion 33 is disengaged from the selected one of the positioning grooves 13, and the abutted surface 34 is spaced from the inner wall of the selected one of the positioning grooves 13 (shown in FIG. 4).

Figure 5:
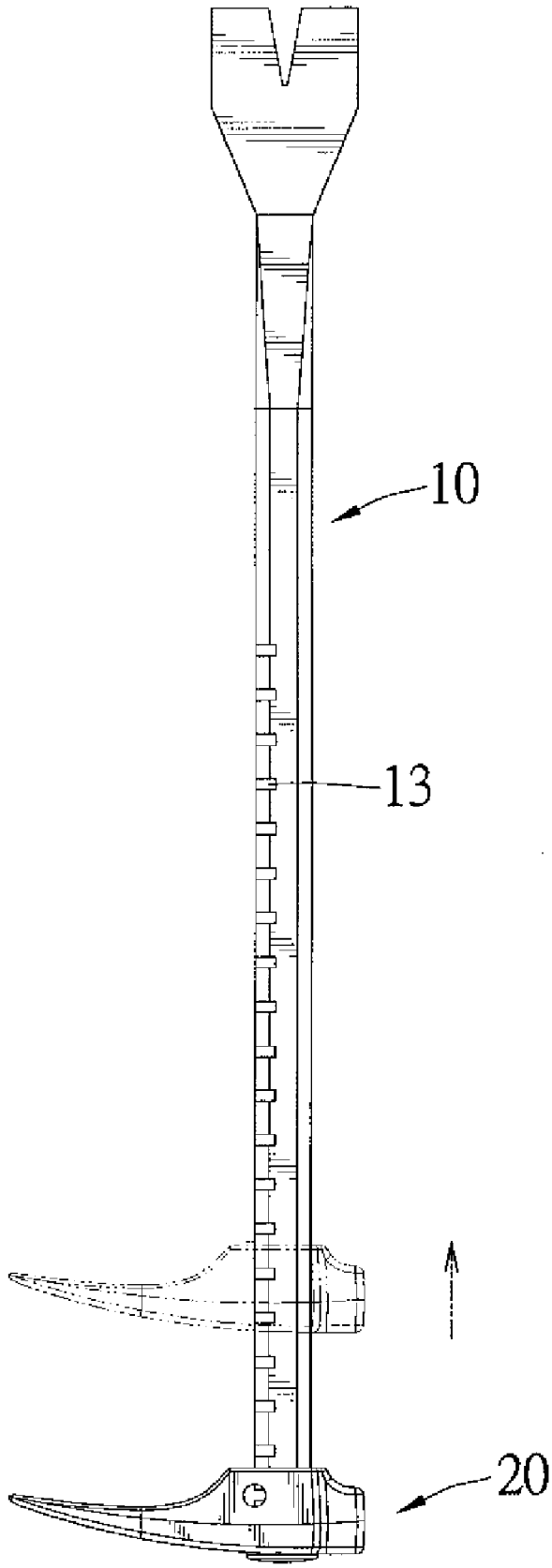
FIG. 5 is a side view of the multi-function tool shown in FIG. 1.

Therefore, further referring to FIG. 5, the location of the pry bar 20 relative to the shank body 10 is adjustable when the clutch 30 is in the disengaging position, and the location of the pry bar 20 on the shank body 10 is fixed when the clutch 30 is in the engaging position. Also, the fixed member 26 is adapted for the multi-function tool to be placed on the ground stably. Accordingly, as the location of the pry bar 20 on the shank body 10 is adjusted to be far from the fixed member 26, the length of nails that are adapted to be pulled by the pry bar 20 could increase.

Figure 6:
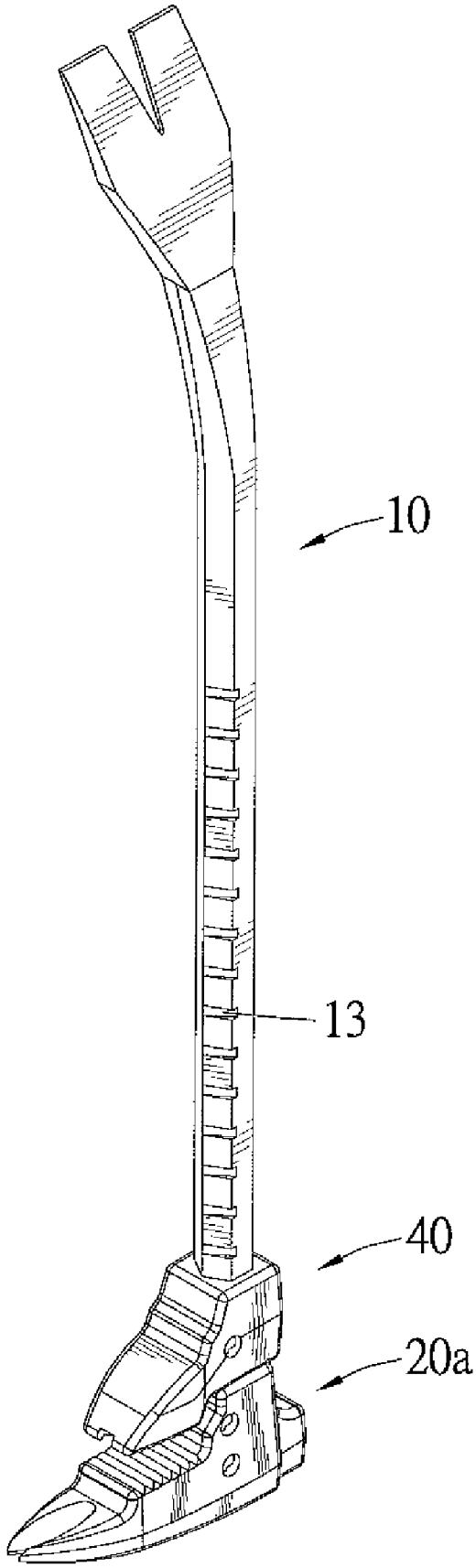
FIG. 6 is a perspective view of a multi-function tool according to the second embodiment of the present invention.
Figure 7:
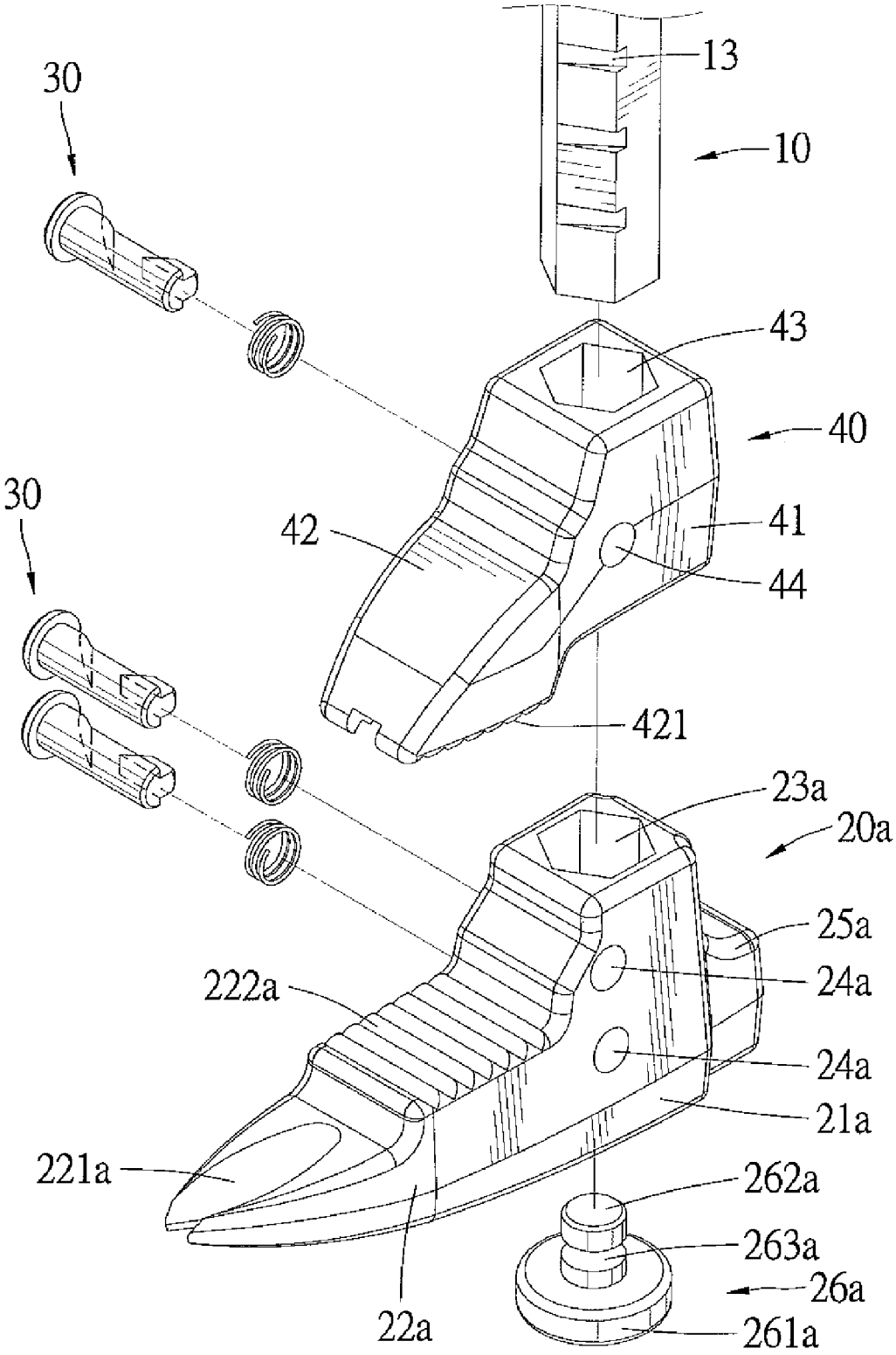
FIG. 7 is a partial, exploded view of the multi-function tool shown in FIG. 6.
Figure 8:
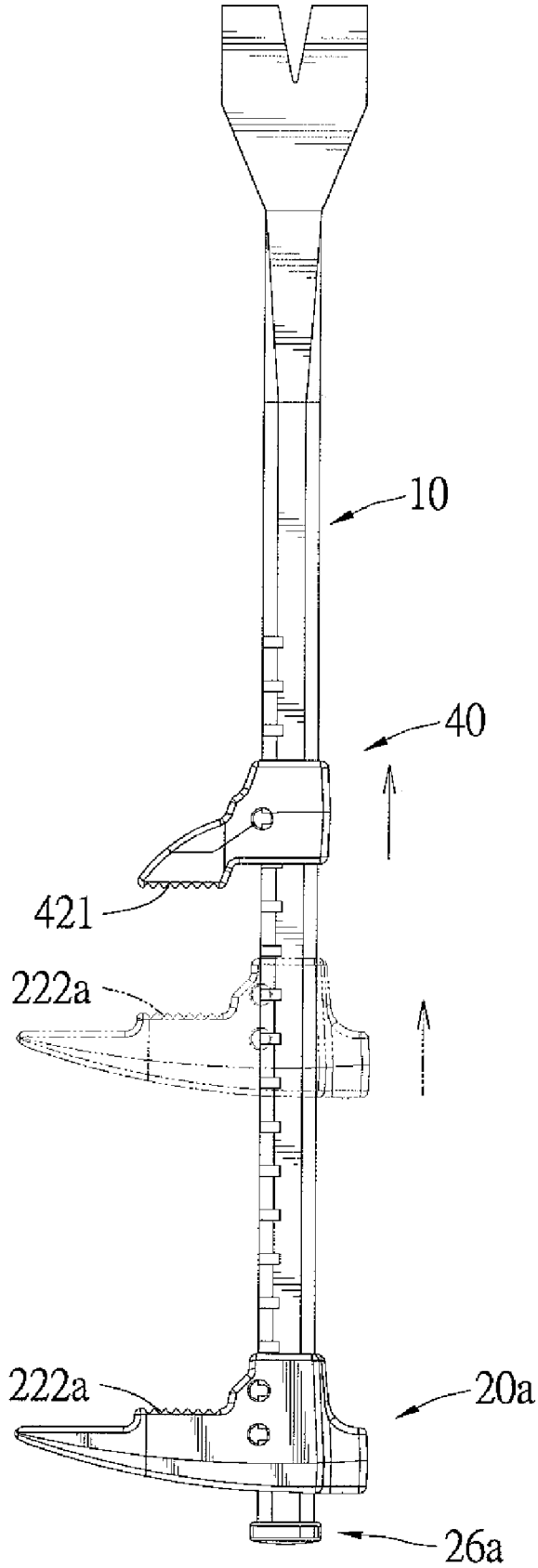
FIG. 8 is a side view of the multi-function tool shown in FIG. 6.

Referring to FIGS. 6 through 8, it shows a second embodiment in the present invention which is similar to the first embodiment except several features below. Firstly, a pry bar 20*a* replaces the pry bar 20. The pry bar 20*a* is similar to the pry bar 20, wherein like numerals are employed to denote like components of the prior embodiment, however bearing the suffix "a ".Two second receptacles 24*a* replace the second receptacle 24. A jaw surface 222*a* is further defined on the working section 22*a*.The, second receptacles 24*a* are parallel to each other in a transverse direction, with each of the second receptacles 24*a* provided to receive one clutch 30. Secondly, a jaw device 40 is mounted on the shank body 10, with the jaw device 40 disposed above the pry bar 20*a*. The jaw device 40 includes a connected end 41, a jaw end 42 extending from a side of the connected end 41 and a hexagonal through-hole 43 piercing the connected end 41 and corresponding to the through-hole 23*a*. Thus, the shank body 10 is adapted to be inserted through the through-holes 43 and 23*a* in sequence. A receptacle 44 pierces the connected end 41 for receiving the clutch 30, with the direction of axis of the receptacle 44 being perpendicular to that of the through-hole 43 and that of the jaw end 42, respectively. A jaw surface 421 is defined on the jaw end 42 relative to the jaw surface 222*a* of the pry bar 20*a*. Therefore, the cooperation of the jaw surface 421 of the jaw device 40 and the jaw surface 222*a* of the pry bar 22*a* is adapted for clamping material which is in a form of a block. In this embodiment, the three clutches 30 are provided to alternatively fix the jaw device 40 and the pry bar 20*a* on the shank body 10, respectively. Hence, points of the multi-function tool in accordance with this embodiment are adjusting the location of the jaw device 40 and the pry bar 20*a* on the shank body 10 for clamping materials and pulling nails via the pry bar 20*a* and the head portion 111 of the shank body 10.

Figure 9:
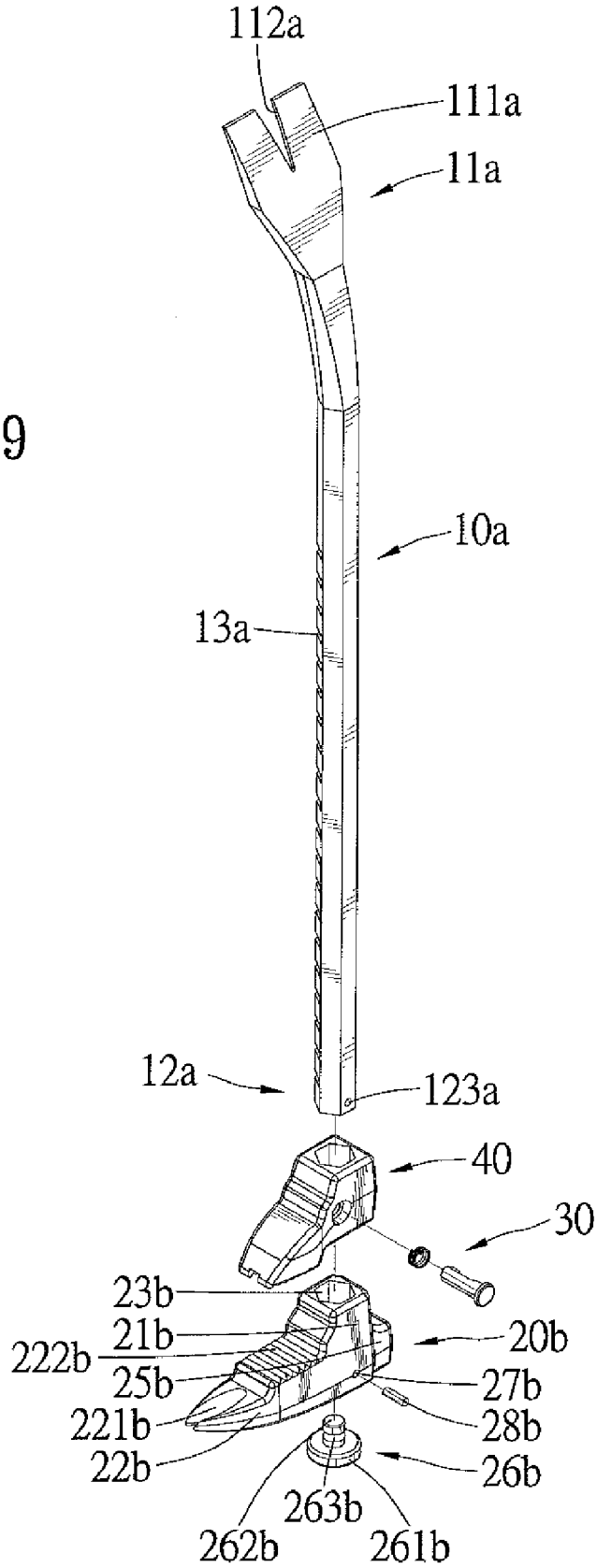
FIG. 9 is an exploded view of a multi-function tool according to the third embodiment of the present invention.
Figure 10:
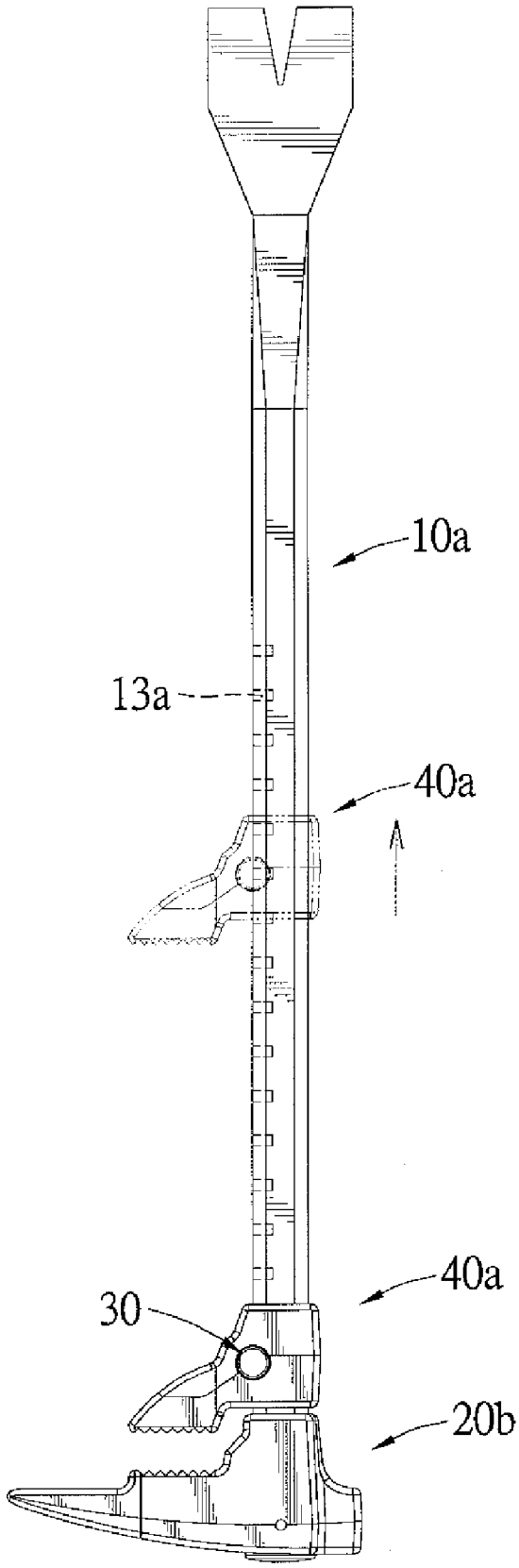
FIG. 10 is a side view of the multi-function tool shown in FIG. 9.

FIGS. 9 to 10 show a third embodiment in the present invention which is similar to the second embodiment except several features below. Firstly, a shank body 10*a* replaces the shank body 10. The shank body 10*a* is similar to the shank body 10, wherein like numerals are employed to denote like components of the prior embodiment, however bearing the suffix "a ". An orifice 123*a* is provided on the periphery of the second end 12*a*. Secondly, a pry bar 20*b* replaces the pry bar 20*a*. The pry bar 20*b* is similar to the pry bar 20*a*, wherein like numerals are employed to denote like components of the prior embodiment, however bearing the suffix "b ". The second receptacles 24*a* are removed, an orifice 27*b* is defined on a side of the connected section 21*b* and relative to the orifice 123*a* so that a pin 28*b* is provided to insert through the orifices 27*b* and 123*a* in sequence for fixing the pry bar 20*b* on the second end 12*a* of the shank body 10*a*. Hence, points of the multi-function tool in accordance with this embodiment are the location of the pry bar 20*b* on the shank body 10*a* is fixed and the location of the jaw device 40 on the shank body 10*a* is adjustable.

Figure 11:
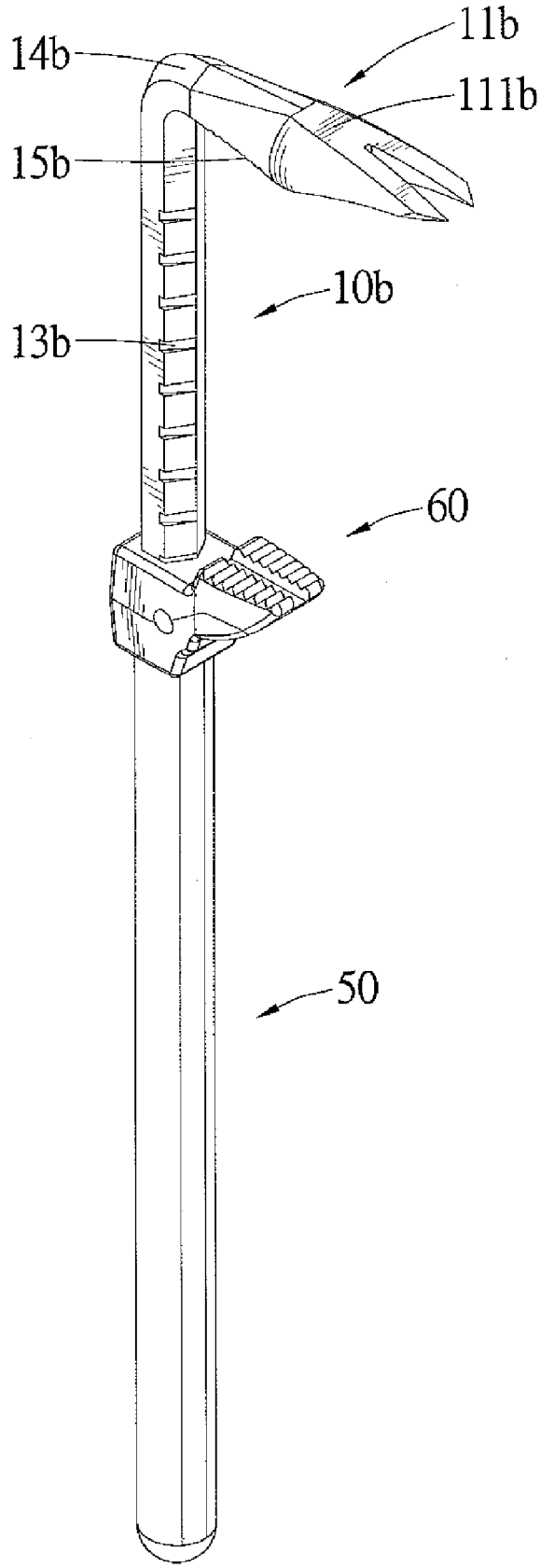
FIG. 11 is a perspective view of a multi-function tool according to the fourth embodiment of the present invention.
Figure 12:
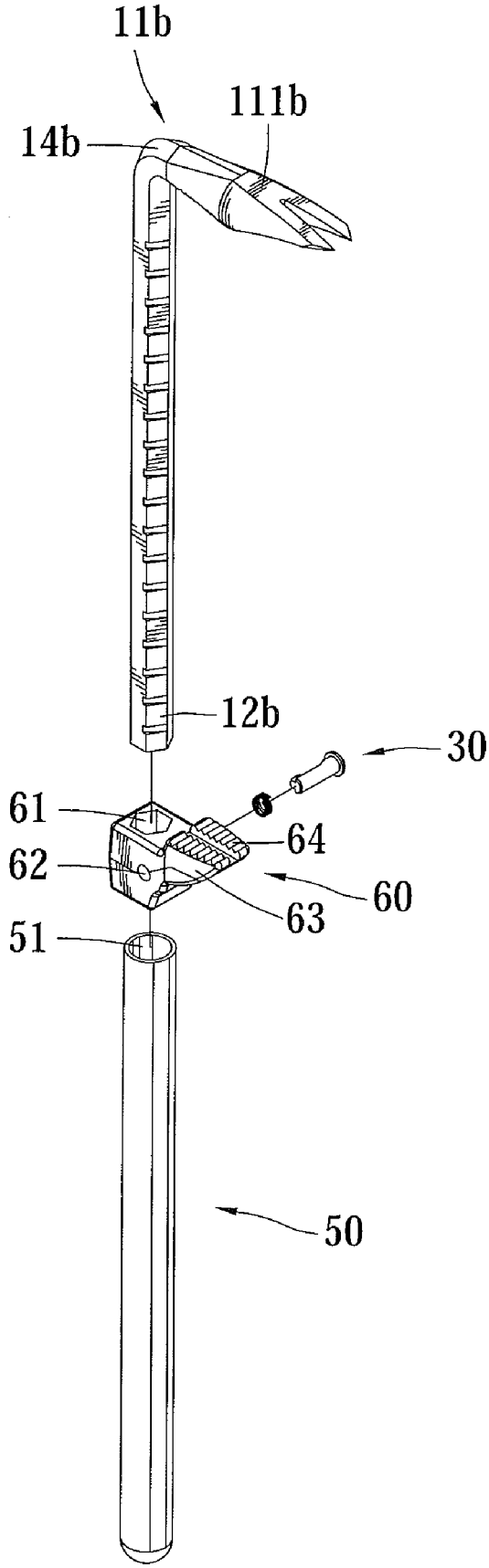
FIG. 12 is an exploded view of the multi-function tool shown in FIG. 11.

FIG. 11 shows a fourth embodiment in the present invention. A multi-function tool includes a hexagonal shank body 10*b*, a handle 50 and a joint 60 connecting the shank body 10*b* and the handle 50 to each other. The shank body 10*b* is similar to the shank body 10, wherein like numerals are employed to denote like components of the prior embodiment, however bearing the suffix "b ". A bent portion 14*b* is defined between the first and second ends 11*b* and 12*b* so that the head portion 111*b* is approximately L-shaped. A jaw surface 15*b* is defined on the bottom surface of the head portion 111*b*. The handle 50 is hollow and includes a first end defining a hole 51 therein for receiving the second end 12*b* of the shank body 10*b* and a second end for a user to hold. The joint 60 is disposed between the shank body 10*b* and the handle 50 and includes a through-hole 61 and a receptacle 62 piercing therethrough, respectively. The direction of axis of the through-hole 61 is parallel to that of the second end 12*b* but perpendicular to that of the receptacle 62. The receptacle 62 is provided to receive one clutch 30 that serves to adjust the location of the joint 60 on the shank body 10*b*. The through-hole 61 has a first end for receiving the second end 12*b* and a second end for receiving the first end of the handle 50. The cross-section of the first end of the through-hole 61 coincides with that of the second end 12*b*, with the cross-section of the second end of the through-hole 61 coinciding with that of first end of the handle 50. Thus, the shank body 10*b* can telescope with respect to the handle 50 stably. A jaw portion 63 extends from a side of the joint 60 relative to the head portion 111*b*, and a jaw surface 64 is provided on the top surface of the jaw portion 63 relative to the jaw surface 15*b*. Thus, the cooperation of the jaw surfaces 15*b* and 64 is adapted for clamping material.

What is claimed is:

1. A multi-function tool comprising:

a shank body including a first end, a second end and a plurality of positioning grooves formed between the first and second ends thereof, with each of the plurality of positioning grooves including an inner wall;

a pry bar including a connected section and a working section extending from a side of the connected section for pulling nails, with a through-hole piercing the connected section along an axis and for slidably receiving the shank body in a slide direction including the first and second ends and along the axis of the through-hole, with a receptacle piercing the connected section along an axis and in communication with the through-hole; and a clutch slideably disposed in the receptacle in a slide direction along the axis of the receptacle and for alternatively engaging with a selected one of the positioning grooves, with the clutch including a protrusion on a side of an end thereof, with the protrusion moveable in the slide direction for exactly inserting into the selected one of the positioning grooves, an abutted surface defined on the protrusion so that when the protrusion is inserted in the selected one of the positioning grooves, the abutted surface abuts with the inner wall of the positioning groove for secure engagement of the pry bar and the shank body, with the inner wall being at an acute angle to the slide direction;

wherein the slide direction of the axis of the receptacle is perpendicular to the slide direction of the axis of the through-hole of the pry bar, and wherein the slide direction of the axis of the clutch is perpendicular to the shank body.

2. The multi-function tool as claimed in claim 1, with the second end including a receiving portion defined therein, with a fixed member including an inserted end disposed in the receiving portion.

3. The multi-function tool as claimed in claim 2, further comprising a projection formed on the inner wall of the receiving portion and an annular groove formed on the inserted end for engaging with the projection for securely engagement of the fixed member and the second end of the shank body.

4. The multi-function tool as claimed in claim 3, further comprising a further receptacle defined on a bottom of the through-hole of the pry bar and a flange defined on an end of the fixed member opposite to the inserted end, with the flange slightly protruding from the further receptacle while the fixed member is disposed in the receiving portion of the shank body.

5. The multi-function tool as claimed in claim 1, with the clutch including a sunken portion provided on another end thereof and opposite to the protrusion so that the shank body can insert through the clutch and is set in the through-hole of the pry bar without contact with the clutch.

6. The multi-function tool as claimed in claim 5, with the clutch including a flange on the terminal end thereof adjacent to the sunken portion, with the receptacle including a limited end for receiving the flange of the clutch, with the diameter of the limited end being larger than that of the receptacle.

7. The multi-function tool as claimed in claim 5, with the clutch further including an elastic element; wherein when the clutch is in an engaging position and the elastic element is released, the protrusion is engaged with the selected one of the positioning grooves and the abutted surface abuts with the inner wall of the positioning groove;

wherein when the clutch is in a disengaging position and the elastic element is pressed, the protrusion is disengaged from the positioning groove and the abutted surface is spaced from the inner wall of the positioning groove.

8. The multi-function tool as claimed in claim 1, with intervals between each of the positioning grooves alternatively being constant.

9. The multi-function tool as claimed in claim 1, with the first end of the shank body including a head portion and a slot defined on the head portion for nail pulling.

10. A multi-function tool comprising:

a shank body including a first end, a second end and a plurality of positioning grooves formed between the first and second ends thereof;

a pry bar including a connected section and a working section extending from a side of the connected section for pulling nails, with a through-hole longitudinally piercing the connected section for slidably receiving the shank body, with a jaw surface defined on the connected section, with a receptacle transversely piercing the connected section and in communication with the through-hole;

a jaw device including a through-hole corresponding to the through-hole of the pry bar for receiving the shank body therethrough and a jaw surface relative to the jaw surface of the pry bar, with the cooperation of the jaw surfaces of the pry bar and the jaw device adapted for clamping material; and a clutch provided to respectively insert through the jaw device and the pry bar for alternatively fixing the jaw device and the pry bar on the shank body, with the clutch received in the receptacle;

wherein the direction of an axis of the receptacle is perpendicular to that of the through-hole of the pry bar and the direction of an axis of the clutch is perpendicular to that of the shank body.

11. The multi-function tool as claimed in claim 10, with the second end including a receiving portion defined therein, with a fixed member including an inserted end disposed in the receiving portion.

12. The multi-function tool as claimed in claim 11, further comprising a projection formed on the inner wall of the receiving portion and an annular groove formed on the inserted end for engaging with the projection for secure engagement of the fixed member and the second end of the shank body.

13. The multi-function tool as claimed in claim 12, further comprising a further receptacle defined on the bottom of the through-hole of the pry bar and a flange defined on an end of the fixed member opposite to the inserted end, with the flange slightly protruding from the further receptacle while the fixed member is disposed in the receiving portion of the shank body.

14. The multi-function tool as claimed in claim 10, with the jaw device including a connected end and a further receptacle piercing the connected end for receiving a further clutch, with the through-hole of the jaw device defined on the connected end of the jaw device.

15. The multi-function tool as claimed in claim 10, with the jaw device including a jaw surface thereon, with the pry bar including a jaw surface thereon and relative to the jaw surface of the jaw device.

16. The multi-function tool as claimed in claim 10, with the clutch including a protrusion on a side of an end thereof for exactly inserting into the selected one of the plurality of positioning grooves, an abutted surface defined on the protrusion so that when the protrusion is inserted in the selected one of the plurality of positioning grooves, the abutted surface abuts with the inner wall of the selected one of the plurality of positioning grooves.

17. The multi-function tool as claimed in claim 16, with the clutch including a sunken portion provided on another end thereof and opposite to the protrusion with the shank body inserted through the clutch and set in the through-hole of the pry bar without contact with the clutch.

18. The multi-function tool as claimed in claim 17, with the clutch including a flange on the terminal end thereof adjacent to the sunken portion, with the receptacle including a limited end for receiving the flange of the clutch, with the diameter of the limited end being larger than that of the receptacle.

19. The multi-function tool as claimed in claim 17, with the clutch further including an elastic element; wherein when the clutch is in an engaging position and the elastic element is released, the protrusion is engaged with the selected one of the positioning grooves and the abutted surface abuts with the inner wall of the positioning groove;

wherein when the clutch is a disengaging position and the elastic element is pressed, the protrusion is disengaged from the positioning groove and the abutted surface is spaced from the inner wall of the positioning groove.

20. The multi-function tool as claimed in claim 10, with intervals between each of the positioning grooves alternatively being constant.

21. A multi-function tool comprising:

a shank body including a first end, a second end and a plurality of positioning grooves formed between the first and second ends thereof;

a handle adapted for slidably receiving the shank body;

a joint provided for connecting the shank body and the handle to each other; and a clutch moveably disposed in the joint for alternatively fixing the joint on a selected one of the positioning grooves;

wherein the clutch includes a protrusion for exactly inserting into the selected one of the positioning grooves and a sunken portion, with the clutch moveable between an engaging position and a disengaging position, with the protrusion received in the selected one of the positioning grooves in the engaging position, with the shank body located within and moveably disposed in the sunken portion in the disengaging portion, with the first end of the shank bar including a bent portion.

22. The multi-function tool as claimed in claim 21, with the joint including a jaw portion relative to a head portion and a jaw surface provided on a top surface of the jaw portion, with the head portion including a jaw surface relative to the jaw surface of the joint.

23. The multi-function tool as claimed in claim 21, with the joint including a through-hole and a receptacle piercing therethrough, respectively, with the clutch moveably disposed in the receptacle between the engaged and disengaged positions in a direction, with the shank body moveable through the through-hole in a direction of an axis of the through-hole perpendicular to of the direction of the clutch moving in the receptacle.

24. The multi-function tool as claimed in claim 23, with the cross-section of a first end of the through-hole coinciding with that of the second end of the shank body, with the cross-section of a second end of the through-hole coinciding with that of an end of the handle which is connected to the shank body.

25. The multi-function tool as claimed in claim 21, with the clutch further including an abutted surface defined on the protrusion so that when the protrusion is inserted in the selected one of the positioning grooves, the abutted surface just abuts with an inner wall of the selected one of the positioning grooves.

26. The multi-function tool as claimed in claim 25, with the sunken portion provided on an end of the clutch and opposite to the protrusion so that the shank body is inserted through the clutch and set in the through-hole of the pry bar without contact with the clutch.

27. The multi-function tool as claimed in claim 26, with the clutch further including an elastic element; wherein when the clutch is in the engaging position and the elastic element is released, the protrusion is engaged with the selected one of the positioning grooves and the abutted surface abuts with an inner wall of the selected one of the positioning grooves; wherein when the clutch is in the disengaging position and the elastic element is pressed, the protrusion is disengaged from the positioning groove and the abutted surface is spaced from the inner wall of the selected one of the positioning grooves.

28. The multi-function tool as claimed in claim 21, with the clutch including a flange on the terminal end thereof adjacent to the sunken portion.

29. The multi-function tool as claimed in claim 21, with intervals between each of the positioning grooves alternatively being constant.

* * * * *